US005751661A

United States Patent [19]

Walters

[11] Patent Number: 5,751,661

[45] Date of Patent: May 12, 1998

[54] MEDICATION DOSAGE TIMING APPARATUS

[75] Inventor: Stephen M. Walters, Penn Valley, Calif.

[73] Assignee: Tri-Continent Scientific, Inc., Grass Valley, Calif.

[21] Appl. No.: 695,728

[22] Filed: Aug. 12, 1996

[51] Int. Cl.[6] ..... G04B 47/00; G04C 57/00; G07F 11/00

[52] U.S. Cl. ..... 368/10; 368/204; 368/278; 221/2

[58] Field of Search ..... 368/10, 276, 278, 368/204, 88; 206/531, 594; 221/2, 3, 15

[56] References Cited

U.S. PATENT DOCUMENTS

| | | | |
|---|---|---|---|
| 3,879,931 | 4/1975 | Tasura et al. | 368/204 |
| 4,361,408 | 11/1982 | Wirtschafier | 368/10 |
| 4,367,955 | 1/1983 | Ballen | 368/10 |
| 4,419,016 | 12/1983 | Zoltan | 368/10 |
| 4,939,705 | 7/1990 | Hamilton et al. | 368/10 |
| 5,016,230 | 5/1991 | Seifers et al. | 368/10 |
| 5,313,439 | 5/1994 | Albeck | 368/10 |

OTHER PUBLICATIONS

Prescript Timecap Medication System, Wheaton Medical Technologies, p. 141, 1988.

MEMS Medication Management System, Aprex Corporation, May 1994.

MEMS Smartcap, Aprex Corporation, May 1994.

MEMS Trackcap, Aprex Corporation, May 1994.

*Primary Examiner*—Vit W. Miska

*Attorney, Agent, or Firm*—John P. O'Banion

[57] ABSTRACT

A medication dosage timing apparatus which measures and displays time in response to the opening and closing of a medication bottle or container. A timing circuit and display are mounted on a circuit board and attached to a container cap. A battery is mounted on a disk which slidably moves within the container cap between a first position wherein electrical contacts on the circuit board engage the battery and activate or power the timing circuit and display, and a second position wherein the electrical contacts are disengaged from the battery and the timing circuit and display are deactivated. When the container cap is attached to the container, the battery and disk are held in the first activating position, and when the container cap is removed from the container, the battery and disk slide down into second, deactivating position. Each time a user opens and closes the medication container, the timing circuit and display are reset and re-started. By observing the display on the cap of the closed container, the user can ascertain the time elapsed since the container was last opened to remove medication.

9 Claims, 5 Drawing Sheets

MEDICATION DOSAGE TIMING APPARATUS

BACKGROUND OF THE INVENTION

1. Field of the Invention

This invention pertains generally to devices and methods for determining or measuring the time elapsed between each dispensation or taking of doses of medication, and more particularly to a medication dosage timing apparatus which displays on a container cap the time elapsed since the last medication dosage was removed from a medication container, and which is automatically reset and reactivated each time the medication container is used.

2. Description of the Background Art

Many persons or patients are involved in medical treatment regimes wherein it is necessary to take a set dose of medication or medications at regular intervals of time. Failure by such patients to take the required medication dosages at the appropriate time intervals results in incorrect blood serum levels of the medication, and can ultimately lead to unfavorable clinical outcomes. Patients who must take numerous medications on a regular basis can easily loose track of the time at which a particular medication was most recently taken. Frequently, the timing requirements vary for dosages of different medications and further lead to patient confusion and error in taking the different medications at correct time intervals.

Various devices, systems and methods have been developed to aid in the correct timing of administration of medication by patients. Previously known dosage timing and measuring devices and methods, however, have generally proved inconvenient, complex and/or difficult to use, and thus tend to be ignored by persons on strict medication regimes, leading to the aforementioned problem of incorrect blood serum levels of necessary medications. Particularly, where medication dispensing devices require activation of a timer, and a patient must take one or more medications several times per day, the patient may neglect to set or activate the timer after taking each medication. Further, many timing devices which patients use for timing of medication doses are separate from or not associated with the medication container, which increases the likelihood of a patient neglecting to accurately time the interval between medication doses.

Accordingly, there is a need for a medication dosage timing apparatus which is quick and simple to use, which does not require activation of a timer, and which is integral to the top or cap of a medication container. The present invention satisfies these needs, as well as others, and generally overcomes the deficiencies found in the background art.

SUMMARY OF THE INVENTION

This invention pertains to a medication dosage timing apparatus which is quick, easy and convenient to use, which is integral to the top or cap of a medication bottle or container, and which automatically resets and activates upon the opening and closing of a medication container. In general terms, the invention comprises means for measuring time and means for displaying time intervals which are included on or associated with a container cap, and means for activating and resetting the timing and display means which are responsive to the removal and replacement of the container cap on a medication container.

By way of example and not of limitation, the time measuring means comprises a conventional solid state timing device. The display means preferably comprises a conventional liquid crystal display (LCD) which is interfaced with the timer. The timer and LCD are mounted on a circuit board and interfaced with each other in a conventional manner. The circuit board snap fits onto a container or bottle cap which has an opening or port to allow users to view the LCD. A disk or plate is included within the container cap and is structured and configured to hold a battery beneath the circuit board. Electrical contacts are provided on the circuit board and are structured and configured to contact the battery and power the timer and LCD when the battery is contacted. The plate is loosely associated with the container cap so that the plate (and attached battery) slidably moves within the container cap between a first, activating position and a second, deactivating position. In the second, deactivating position, the container lid is removed from or otherwise not attached to a container. In the first, activating position, the disk and battery are positioned so that the electrical contacts on the circuit board engage the battery to activate and power the timer and LCD. In the second, deactivating position, the battery and disk within the container cap are positioned away from the electrical contacts on the circuit board so that the contacts are separated from, and not in contact with, the battery, thus deactivating the timer and LCD. The disk and battery slidably move into the first, activating position when the container lid is replaced on the container, and the disk and battery slidably move to the second, deactivating position when the container cap is removed from the container.

The invention is used by simply removing and replacing the container top from a medication container in a conventional manner as required for removing medication from the container. When the container top is removed from the container by a user to remove medication from the container, the timer and LCD are deactivated and turn off. When the user replaces the cap on the container, the timer and LCD are automatically activated and start measuring and displaying time. The user can ascertain the time period which has elapsed since the last dosage of medication was removed from the container by simply looking at the container cap, which displays the time elapsed since the container lid was last replaced on the container. The user does not need to take any steps to keep track of the timing between dosages other than the opening and closing of the medication container itself.

An object of the invention is to provide a medication dosage timing apparatus which prevents patients from losing track of the time interval elapsed between the taking of doses of medication.

Another object of the invention is to provide a medication dosage timing apparatus which automatically measures and displays elapsed time in response to the opening and closing of a medication container.

Another object of the invention is to provide a medication dosage timing apparatus which is quick and simple to use.

Another object of the invention is to provide a medication dosage timing apparatus which does not require record keeping by a user.

Another object of the invention is to provide a medication dosage timing apparatus which does not require activation of buttons for measuring time intervals.

Another object of the invention is to provide a medication dosage timing apparatus which is attached to a medication container.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

Figure 5:
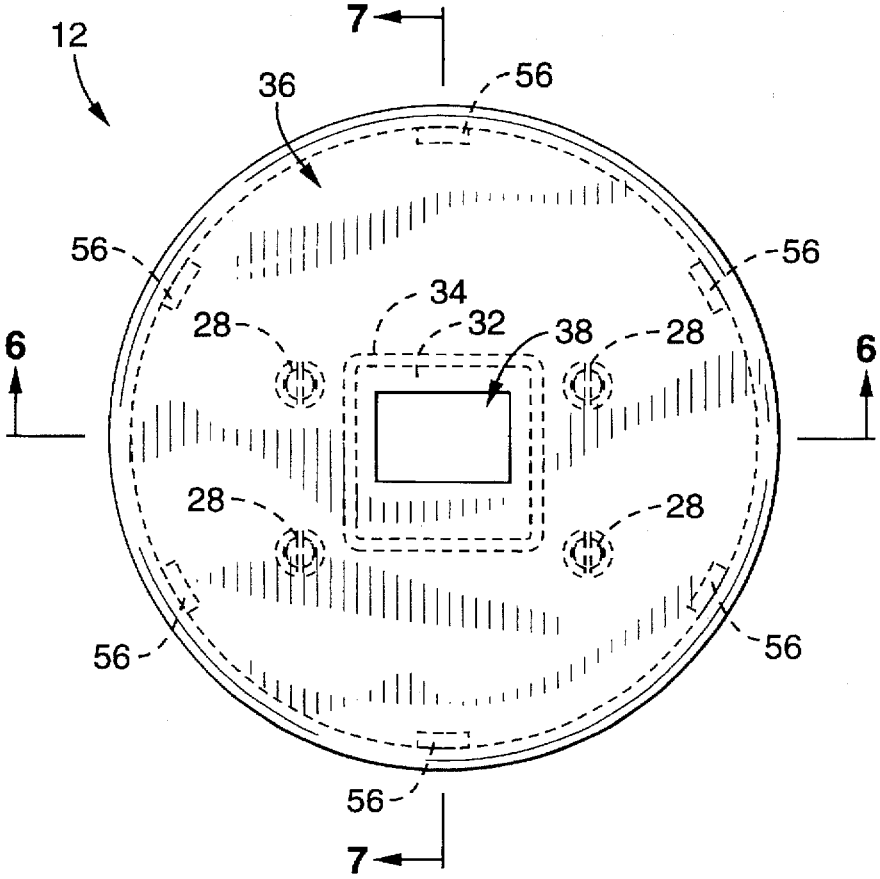
FIG. 5 is a bottom plan view of the container lid of the medication dosage timing apparatus.
Figure 6:
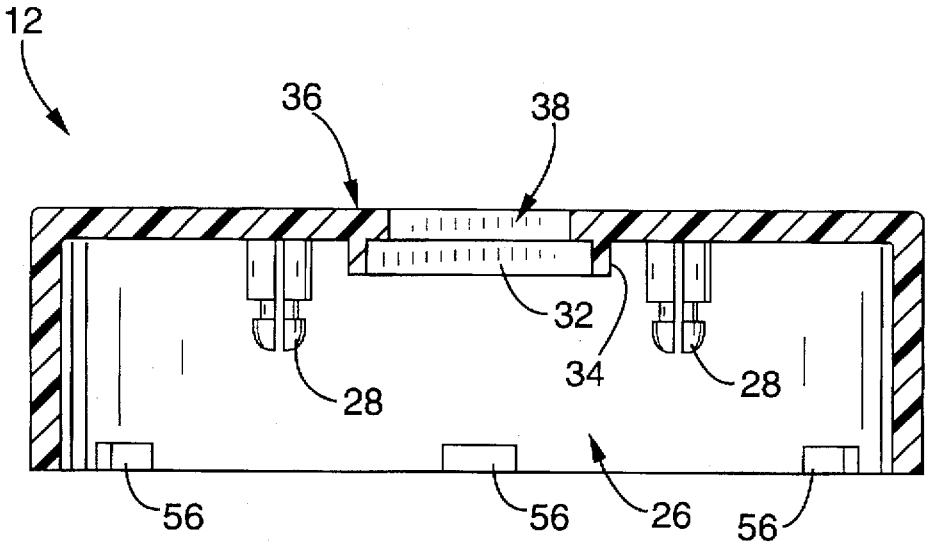
FIG. 6 is a cross-sectional view of the container lid of FIG. 5 taken through line 6—6.
Figure 7:
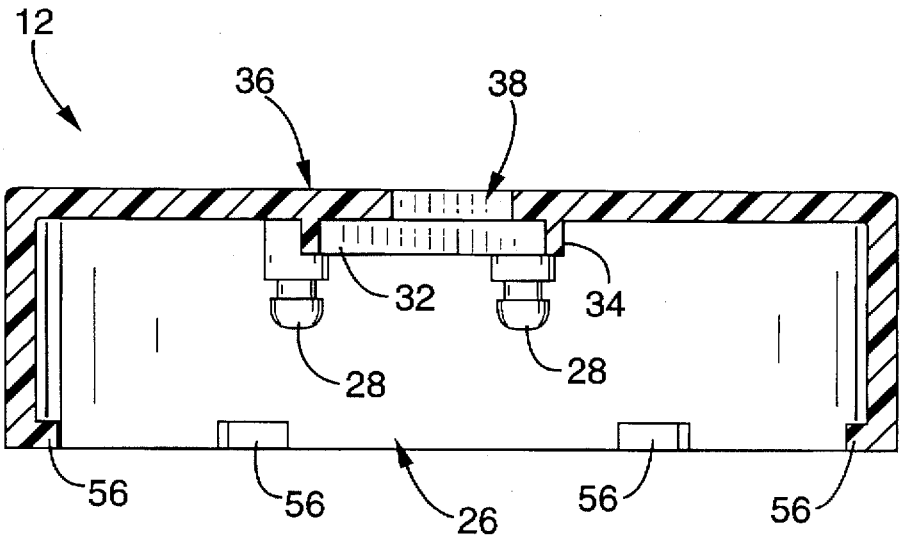

FIG.,7 is a cross-sectional view of the container lid of FIG. 5 taken through line 7—7.

Figure 8:
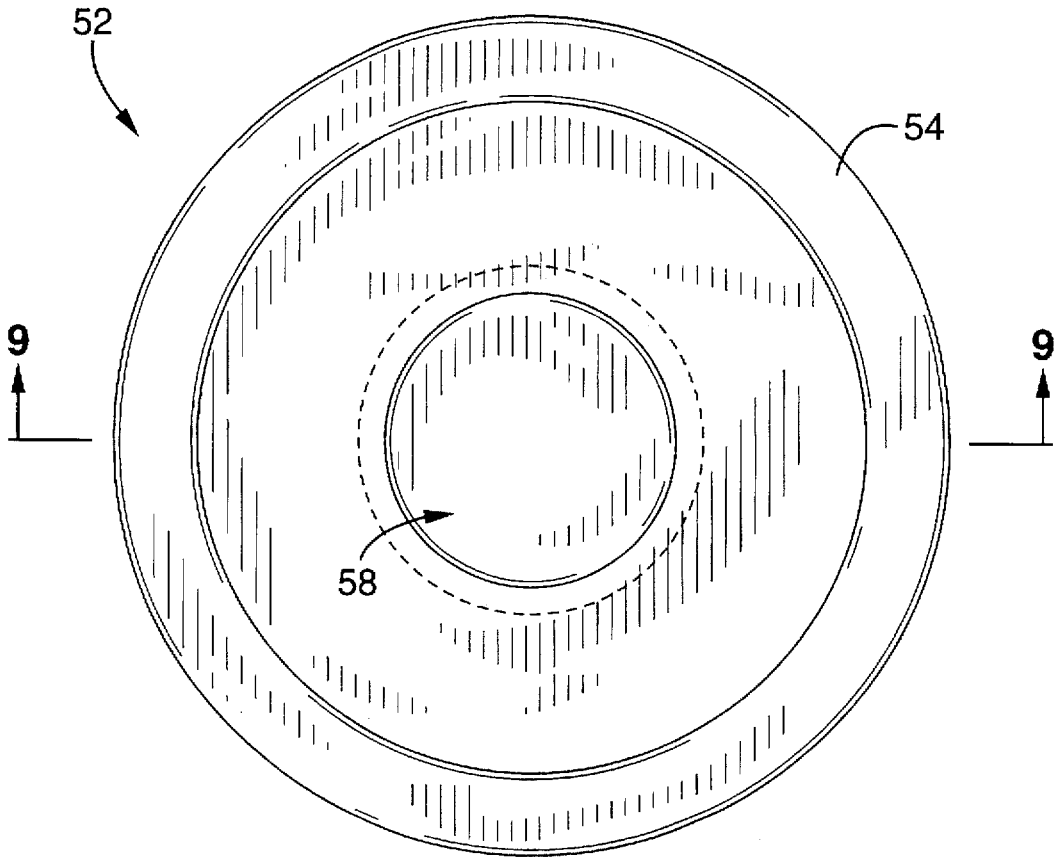

FIG. 8 is a top plan view of the battery supporting disk of the medication dosage timing apparatus.

Figure 9:
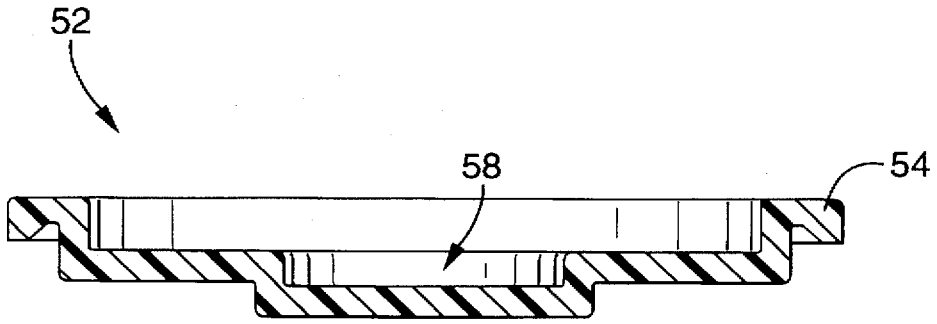

FIG. 9 is a cross-sectional view of the battery supporting disk of FIG. 8 taken through line 9—9.

DESCRIPTION OF THE PREFERRED EMBODIMENTS

Referring more specifically to the drawings, for illustrative purposes the present invention is embodied in the apparatus generally shown in FIG. 1 through FIG. 9. It will be appreciated that the apparatus may vary as to configuration and as to details of the parts without departing from the timer concepts as disclosed herein. The invention is disclosed in terms of measuring the time elapsed between the taking of doses of medication from a medication container. However, it will be readily apparent to those of ordinary skill in the art that the invention may be used for measuring the time intervals between various events associated with the opening and closing of numerous types of containers.

Referring now to FIG. 1 through FIG. 9, a medication dosage timing apparatus 10 in accordance with the present invention is generally shown. The invention preferably includes a container top, lid or cap 12 which is used in association with a medication container as discussed below. Container cap 12 may vary in structure and configuration as necessary to accommodate different types and styles of medication containers. Container cap 12 is shown in a preferred structure and configuration for use with a conventional medication vial or bottle of the type used for holding medication in pill or tablet form. Other structures and configurations for container cap 12 may also be used with the invention depending upon the type of container used therewith.

Means for measuring time are included with the invention, with the time measuring means preferably comprising a timer 14 or like device which counts or measures time by an oscillating crystal or like means. Timer 14 may be fashioned from analog or digital components or be customized into an ASIC or like circuit element. The invention also includes means for displaying time, which are preferably provided as a conventional multi-segment display 16 with at least two digits 18*a*, 18*b*. Display 16 is preferably an LCD device which includes an internal decoder/driver circuit (not shown) such as a 74HC4543 chip. Display 16 may alternatively comprise an LED display or other conventional display means.

Figure 4:
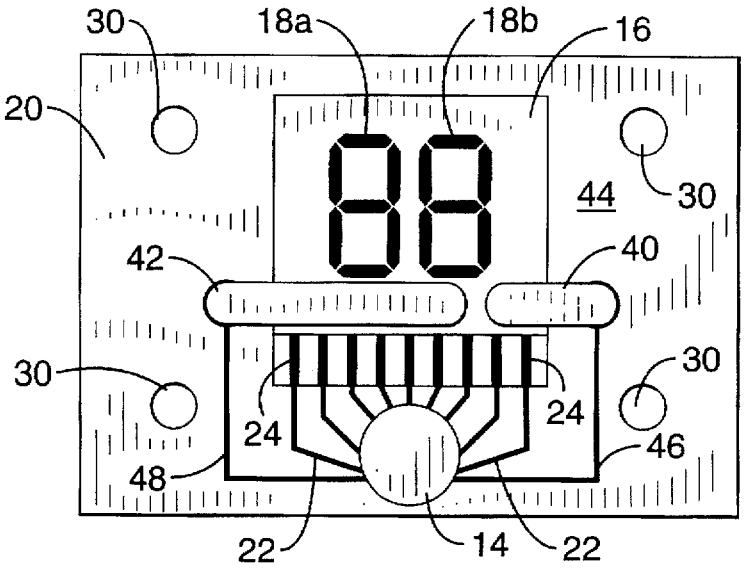
FIG. 4 is a bottom plan view of the timing and display circuit board shown in FIG. 1.

Timer 14 and display 16 are mounted on a circuit board 20, and are operatively coupled to each other by a conventional arrangement of conductors 22 and pins 24 (FIG. 4). Circuit board 20 is coupled to container cap 12 within the interior 26 of container cap 12, preferably by means of a plurality of split studs 28 on container cap 12 which snap fit into a corresponding plurality of openings 30 on circuit board 20. Other standard coupling means may alternatively be utilized to attach circuit board 20 to container cap. Container cap 12 includes a socket 32 defined by an encircling lip 34 which receives display 16 and positions display 16 generally adjacent to the top surface 36 of container cap 12. An opening or port 38 in the top surface 36 of container cap 12 allows display 16 to be viewed through container cap 12. A pair of resilient prongs or electrical contacts 40, 42 are provided on the bottom surface 44 of circuit board 20. Electrical contacts 40, 42 are interfaced with timer 14 and display 16 via conductors 46, 48 respectively.

Means for supplying power to timer 14 and display 16 are provided with the invention, preferably in the form of a conventional watch battery 50. A battery supporting disk 52 is movably mounted within the interior 26 of container cap 12. Disk 52 contains an annular lip 54 which snap fits over a plurality of bosses or projections 56 located about the circumference of the interior 26 of container cap 12. Projections 56 serve to retain disk 52 within the interior 26 of container cap 12. A well or recess 58 is provided in disk 52 to receive battery 50.

Figure 1:
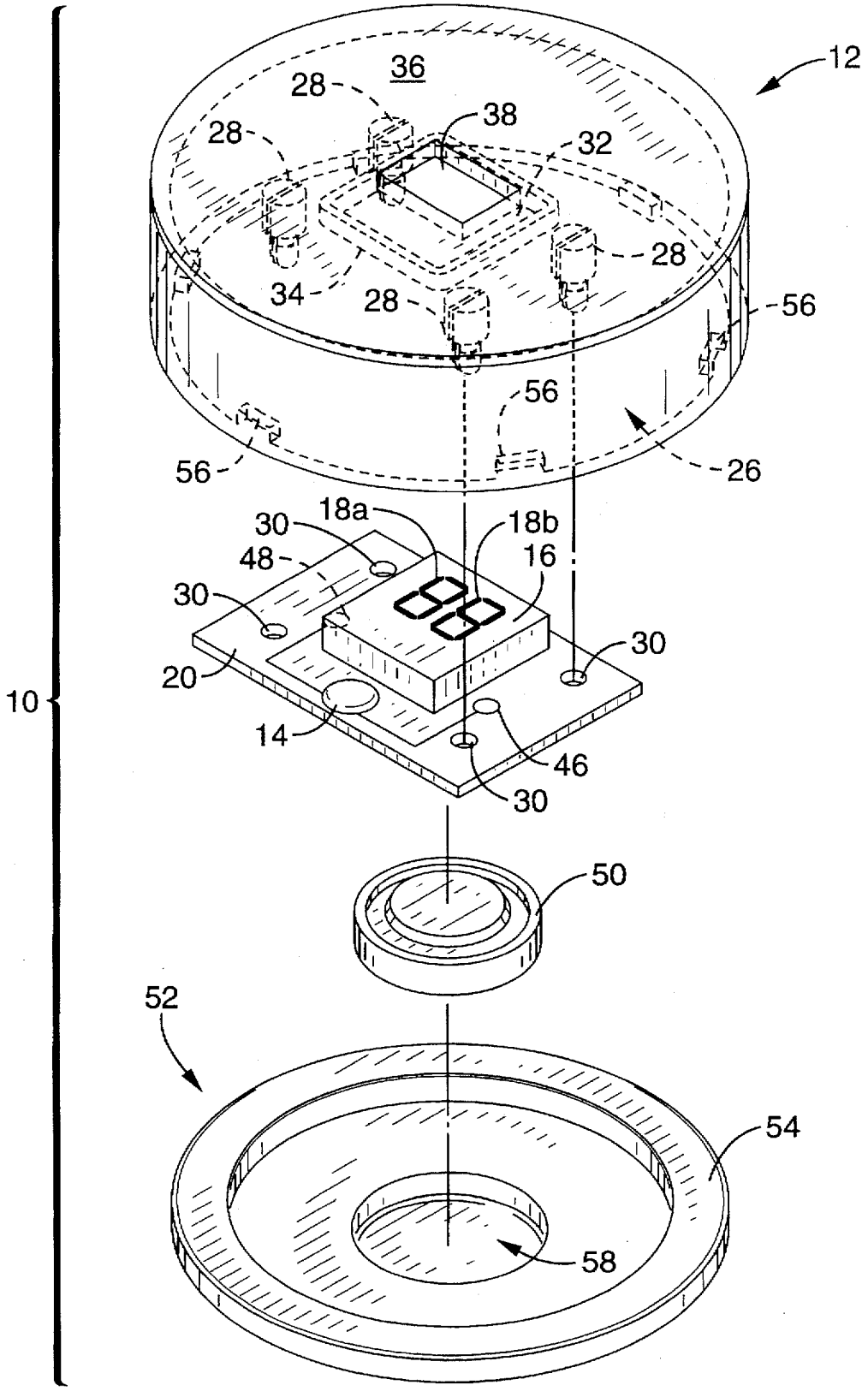
FIG. 1 is an exploded perspective view of a medication dosage timing apparatus in accordance with the present invention.
Figure 2:
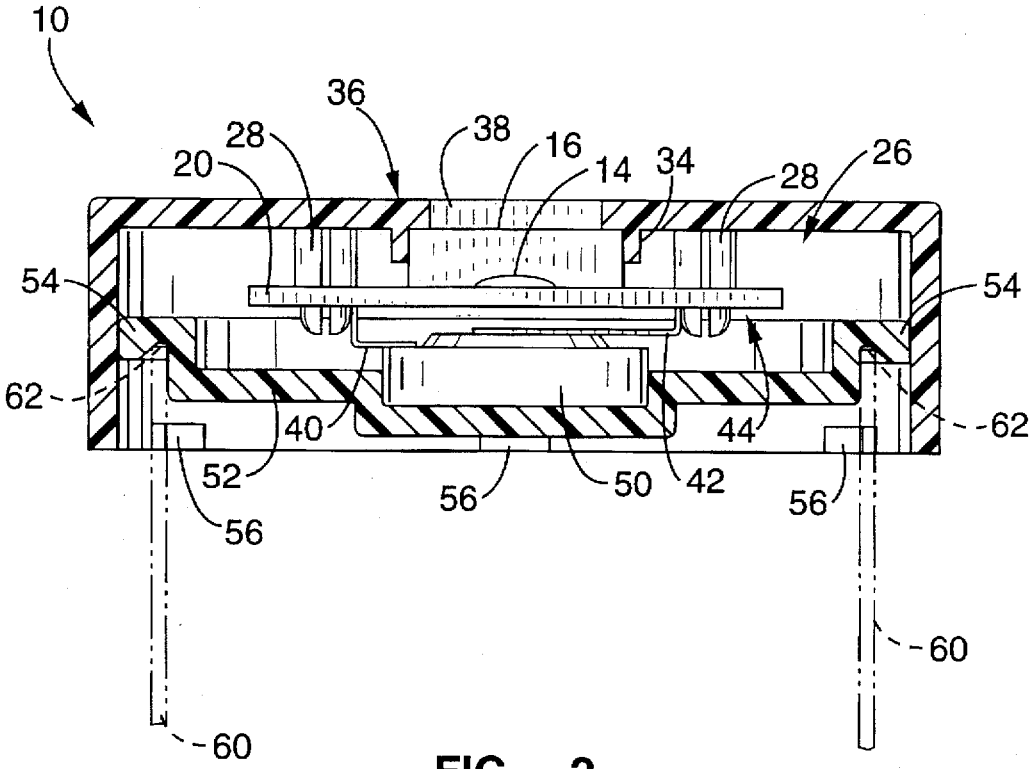
FIG. 2 is a side view in partial cross-section of the medication dosage timing apparatus of the invention showing the battery and support disk in the first, activating position, and showing an attached medication container in phantom and in cross-section.

Disk 52 slidably moves up and down within the interior 26 of container cap 12. Disk 52 and battery 50 generally move within the interior 26 of container cap 12 between a first, activating position, shown in FIG. 2, wherein battery 50 engages, touches or is otherwise in contact with electrical contacts 40, 42, and a second, deactivating position, shown in FIG. 3, wherein battery 50 is disengaged or disconnected from electrical contacts 40, 42. In the second, deactivating position, annular lip 54 on disk 52 rests on projections, with battery 50 disengaged and separated from electrical contacts 40, 42. Disk 52 and battery 50 are held in the first, activating position when the apparatus 10 is attached to a medication container 60 as shown in FIG. 2, and disk 52 and battery 50 move to the second, deactivating position upon removal of container cap 12 from container 60. Container 60 is shown in the configuration of a conventional "pill bottle" or vial. Container cap 12 includes conventional means for detachably coupling to container 60, which may comprise threading (not shown), child-proof detachable coupling arrangements, or like standard attachment means. Preferably, projections 56 around the inner circumference of container cap 12 are utilized for detachably coupling container cap 12 to container 60.

The invention is utilized in the same manner as a conventional medication container cap or top, and requires no additional effort or steps by a user for measuring or tracking time than would otherwise be required for opening and resealing the medication container. As described above, when container cap 12 is attached to medication container 60, the lip 62 of container 60 pushes against lip 54 on disk 52, holding disk 52 and battery 50 in the first, activating position shown in FIG. 2 wherein electrical contacts 42, 44 on circuit board engage or contact battery 50, providing power to timer 14 and display 16. While in the first or activating position the user of the invention can observe the time measured by timer 14 and displayed on display 16 through opening 38 in the top surface 36 of container lid 12.

Figure 3:
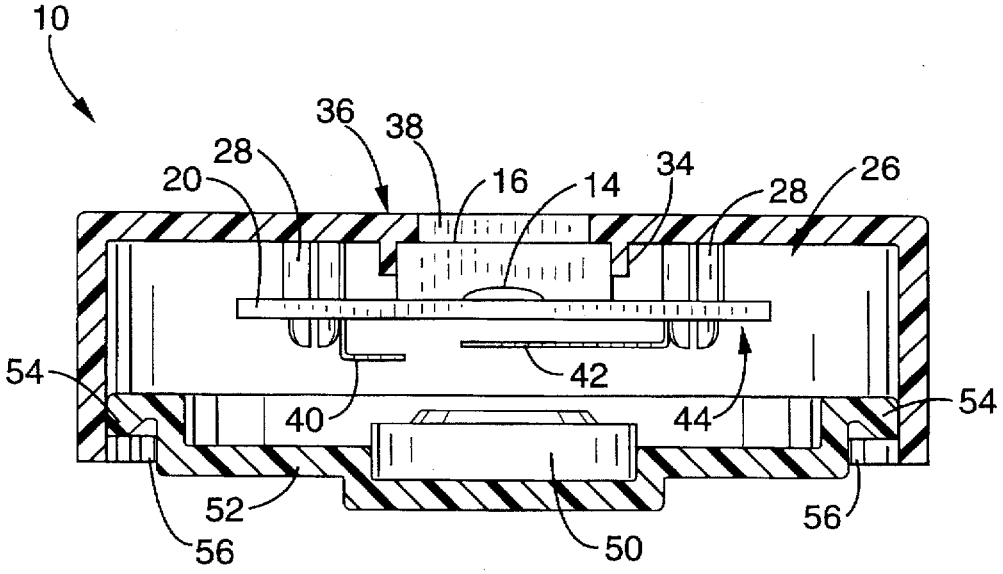
FIG. 3 is a side view in partial cross-section of the medication dosage timing apparatus of the invention showing the battery and support disk in the second, deactivating position.

When the user removes cap 12 from container 60 by unscrewing or the like, lip 62 of container 60 no longer supports lip 54 of disk 52, and disk 52 (and attached battery 50) slidably move downward within the interior 26 of container cap 12 into the second, deactivating position shown in FIG. 3. In the deactivating position, electrical contacts 40, 42 are disengaged or disconnected from battery 50, and no power is provided to timer 14 or display 16. Thus, while in the second position, timer 14 and display 16 are effectively deactivating or turned off. While container cap 12 is removed from container 60, the user may remove a medication dosage from the container 60 in a standard manner, after which container cap 12 is replaced or reattached onto container 60.

As container cap 12 is replaced on container 60, lip 62 on container 60 pushes against lip 54 on disk 52, causing disk 52 and battery 50 to slidably move upward within the interior 26 of container cap 12 towards the first, activating position. When container cap 12 is fully reattached to container 60 and battery 50 and disk 52 are again in the first, activating position, electrical contacts 40, 42 engage battery 50, and timer 14 and display 16 are again powered or activated. The time measured by timer 14 and displayed by display 16 is counted or measured from the time at which container cap 12 was reattached to container 60 and moved into the first, activating position, so that the user of the invention, by merely looking at display 16 via opening 38 in container cap 12, can ascertain the time which has elapsed since removing the last dosage of medication from the container 60. There exist no additional or inconvenient steps or operations which must be carried out by the user of the invention in order to keep track of or measure time elapsed since the taking of the previous dose of medication. The regular opening and closing of the medication container 60 and cap 12 in the standard manner required for accessing the medication within container 60 is all that is necessary for measuring and displaying the time intervals between the removal of medication from container 60.

The medication dosage timing apparatus 10 comprising the invention is particularly advantageous in situations wherein a patient is required to take several medications each day at different timing intervals. For example, a patient may be required take medication A twice per day, medications B and C three times per day, and medication D four times per day. In such a situation, it is easy for a patient to lose track of when a particular medication was last taken, resulting in incorrect timing and incorrect dosages of the various medications. With the present invention, however, the apparatus 10 may be used in association with each medication container, and by reading the display on each container cap, the patient can verify when the most recent dose of each medication was last taken.

Circuit board 20 and battery supporting disk 52 may be structured and configured to fit within different types of container caps, lids and tops other than the container cap 12 shown and described above. For example, the invention may be used with a standard medication container cap which is made of transparent material. Circuit board 20 would be suitably structured and configured to snap fit into the cap or be held therein by adhesives, and disk 52 can be suitably structured and configured to slidably move within the interior of the top or lid between activating and deactivating positions in the manner described above. The user of the invention would then view display 16 through the transparent cap, and the invention would otherwise operate in the same manner as described above.

Accordingly, it will be seen that this invention provides a medication dosage timing apparatus which allows a user to quickly, easily, accurately and automatically determine the time elapsed since the last dosage of a medication has been taken, and which requires no additional effort or procedures by the user other than are required for the opening and closing of a medication container in a normal fashion. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A medication dosage timing apparatus, comprising:

(a) a container cap;

(b) timer means for measuring elapsed time;

(c) display means for displaying said elapsed time, said display means operatively coupled to said timer means;

(d) coupling means for coupling said timer means and said display means to said container cap; and (e) battery carrier means slidably coupled to said container cap for automatically moving a battery between a first position when said container cap is coupled to a container and a second position when said container cap is removed from said container;

(f) said timer means and said display means responsive to movement of said battery carrier means as a result of removal and replacement of said container cap.

2. An apparatus as recited in claim 1, further comprising a circuit board, said timer means and display means mounted on said circuit board, said coupling means included with said circuit board.

3. An apparatus as recited in claim 2, wherein said circuit board includes electrical contacts, wherein said electrical contacts on said circuit board engage said battery when said battery carrier means is in said first position, and wherein said electrical contacts on said circuit board are disengaged from said battery when said battery carrier means is in said second position.

4. An apparatus as recited in claim 3, wherein said battery carrier means comprises a disk positioned within said container cap and structured and configured to carry a battery.

5. A medication dosage timing apparatus, comprising:

(a) a timer;

(b) a display operatively coupled to said timer;

(c) power supply means for supplying power to said timer and said display; and (d) a container cap, said timer and said display coupled to said container cap;

(e) said power supply means movably mounted within said container cap, said power supply means moving between a first position wherein said power supply means provides power to said timer and said display, and a second position wherein said power supply means is disconnected from said timer and said display;

(f) wherein said power supply means automatically moves into said first position when said container cap is attached to a medication container, and said power supply means automatically moves into said second position when said container cap is unattached to a medication container.

6. An apparatus as recited in claim 5, further comprising a circuit board, said circuit board coupled to said container cap, said timer and said display mounted on said circuit board, said circuit board including electrical contacts, said electrical contacts electrically interfaced with said timer and said display, said electrical contacts structured and configured to electrically coupled to said power supply means when said power supply means is in said first position.

7. An apparatus as recited in claim 5, further comprising a disk, said disk movably mounted in said container cap, said power supply means included on said disk.

8. A medication dosage timing apparatus, comprising:

(a) a timer;

(b) a display operatively coupled to said timer;

(c) a circuit board, said timer and said display mounted on said circuit board, said circuit board including electrical contacts, said electrical contacts electrically interfaced with said timer and said display;

(d) a container cap, said circuit board attached to said container cap; and (e) a battery, said battery movably mounted in said container cap;

(f) said battery moving between a first position wherein said electrical contacts on said circuit board are connected to said battery, and a second position wherein said electrical contacts on said circuit board are disconnected from said battery;

(g) wherein said battery automatically moves into said first position when said container cap is attached to a medication container, and said battery automatically moves into said second position when said container cap is unattached to a medication container.

9. An apparatus as recited in claim 8, further comprising a disk, said disk movably mounted in said container cap, said battery included on said disk.

* * * * *